US006205681B1

(12) United States Patent
Kita

(10) Patent No.: US 6,205,681 B1
(45) Date of Patent: Mar. 27, 2001

(54) ATHLETIC SHOE MIDSOLE DESIGN AND CONSTRUCTION

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/318,578

(22) Filed: May 25, 1999

(30) Foreign Application Priority Data

Jun. 8, 1998 (JP) ..... 10-176654

(51) Int. Cl.[7] ..... A43B 13/18
(52) U.S. Cl. ..... 36/28; 36/27; 36/37
(58) Field of Search ..... 36/27, 28, 29, 36/37, 38

(56) References Cited

U.S. PATENT DOCUMENTS

| | | | | |
|---|---|---|---|---|
| 623,549 | | 4/1899 | Jaque . | |
| 1,659,339 | | 2/1928 | Vetterling . | |
| 2,364,134 | | 12/1944 | Dow et al. . | |
| 2,677,906 | * | 5/1954 | Reed | 36/29 |
| 3,170,178 | | 2/1965 | Scholl . | |
| 4,071,963 | * | 2/1978 | Fukuoka | 36/3 B |
| 4,364,186 | * | 12/1982 | Fukuoka | 36/29 |
| 4,561,195 | | 12/1985 | Onoda et al. . | |
| 4,798,010 | | 1/1989 | Sugiyama . | |
| 4,815,221 | | 3/1989 | Diaz . | |
| 4,864,737 | * | 9/1989 | Marrello | 36/28 |
| 4,878,300 | | 11/1989 | Bogaty . | |
| 4,999,931 | | 3/1991 | Vermeulen . | |
| 5,224,280 | | 7/1993 | Preman et al. . | |
| 5,255,451 | * | 10/1993 | Tong et al. | 36/28 |
| 5,528,842 | | 6/1996 | Ricci et al. . | |
| 5,720,118 | | 2/1998 | Mayer et al. . | |
| 5,746,012 | * | 5/1998 | Caletti et al. | 36/3 B |
| 5,974,695 | | 11/1999 | Slepian et al. . | |

FOREIGN PATENT DOCUMENTS

| | | |
|---|---|---|
| 0857434 | 8/1998 | (EP) . |
| 0878142 | 11/1998 | (EP) . |
| 2032760 | 5/1980 | (GB) . |
| 61-6804 | 3/1986 | (JP) . |
| WO90/06699 | 6/1990 | (WO) . |

* cited by examiner

*Primary Examiner*—M. D. Patterson
(74) *Attorney, Agent, or Firm*—W. F. Fasse; W. G. Fasse

(57) ABSTRACT

A midsole assembly for an athletic shoe includes a midsole formed of soft elastic material and a corrugated sheet disposed in a heel portion of the midsole. A plurality of through holes are formed in the midsole at locations where the midsole contacts the corrugated sheet. In this case, transverse deformation of the heel portion of the midsole can be prevented by the wave configuration of the corrugated sheet and running stability of the shoe can be ensured. Also, the cushioning properties of the shoe can be improved at the portions provided with the holes because vertical deformation thereby becomes easier.

13 Claims, 7 Drawing Sheets

ATHLETIC SHOE MIDSOLE DESIGN AND CONSTRUCTION

CROSS-REFERENCE TO RELATED APPLICATIONS

The present application is related to the following copending U.S. applications of the same or overlapping inventors: 09/314,366 filed on May 19, 1999; 09/339,269 filed on Jun. 23, 1999; 09/395,516 filed on Sep. 14, 1999; 09/437,918 filed on Nov. 10, 1999 and 09/571,258, filed on May 15, 2000.

BACKGROUND OF THE INVENTION

The present invention relates to an athletic shoe midsole design and construction. More particularly, the invention relates to a midsole assembly comprising a midsole formed of soft elastic material and a corrugated sheet disposed in the midsole.

The sole of an athletic shoe used in various sports is generally comprised of a midsole and an outsole. The midsole is typically formed of soft elastic material in order to ensure adequate cushioning properties. The outsole is fitted under the midsole and directly contacts with the ground.

Running stability as well as adequate cushioning properties are required in athletic shoes. Consequently, there is a need to prevent shoes from being deformed excessively in the lateral or transverse direction when contacting the ground.

As shown in Japanese Utility Model Examined Publication No. 61-6804, the assignee of the present invention proposes a midsole assembly having a corrugated sheet therein, which can prevent such an excessive lateral deformation of shoes and particularly shoe soles.

The midsole assembly shown in the above publication incorporates a corrugated sheet in the heel portion of a midsole, thereby producing a resistant force that prevents the heel portion of a midsole from being deformed laterally or transversely when a shoe contacts with the ground. Thus, transverse deformation of the heel portion of a shoe is prevented and running stability can be ensured.

Generally, by inserting a corrugated sheet, the heel portion of a midsole tends to be less deformed in the transverse direction and running stability can be improved. However, when the corrugated sheet is formed especially of high elastic material the heel portion of a midsole tends to be less deformed in the vertical direction as well. Thus, by using a corrugated sheet, a portion of the sale of where adequate cushioning properties are required on landing may show undesirably diminished cushioning properties.

The object of the present invention is to provide a midsole assembly for an athletic shoe that can ensure not only running stability but also cushioning properties.

SUMMARY OF THE INVENTION

The present invention provides a midsole assembly for an athletic shoe.

In one embodiment, a midsole assembly comprises a midsole formed of soft elastic material and a corrugated sheet disposed in at least a heel portion of the midsole. A hole is provided at a portion of the midsole contacting the corrugated sheet.

In a second embodiment, the hole is formed on the concave surface side of the wave configuration of the corrugated sheet.

In a third embodiment, the hole is formed on the convex surface side of the wave configuration of the corrugated sheet.

In a fourth embodiment, the hole is formed on the inclined surface between the convex and concave surfaces of the wave configuration of the corrugated sheet.

The hole may extend in the shoe width direction, as described in a fifth embodiment, or it may extend radially, as described in a sixth embodiment.

The hole may be a through hole, as described in a seventh embodiment, or it may be a blind hole with a bottom, as described in an eight embodiment.

The hole may be formed only on the inner or medial side surface of the midsole, as described in a ninth embodiment. In an alternative, the hole may be formed only on the outer or lateral side surface of the midsole, as described in a tenth embodiment, or it may be formed only in the heel central portion of the midsole, without extending to the midsole said surfaces as described in an eleventh embodiment.

According to the present invention, since a corrugated sheet is disposed in at least a heel portion of the midsole, transverse or lateral deformation of the heel portion of the midsole can be prevented, and thus, the stability of a shoe on landing can be ensured.

Moreover, in this case, because there is provided a hole at the portion of a midsole contacting with a corrugated sheet, deformation of the corrugated sheet against a vertical compressive force is made easier at this area provided with a hole. Thereby, cushioning properties on landing can be secured. Furthermore, by forming a hole in the midsole, the whole midsole can be made lightweight.

Additionally, "a hole" in this case includes both a through blind hole and a hole with a bottom, as is clear from the descriptions of the other embodiments, and besides, it also includes a so-called air reservoir that has no opening end on the circumferential surface of a midsole. The sectional shape of a hole can be any kinds of shape and may be a narrow slit formed between the midsole and the corrugated sheet. The hole is especially formed as a linearly extending groove in the midsole adjoining the corrugated sheet, whereby the groove extends linearly along the linearly extending wave corrugations and opens directly onto the corrugated sheet.

The hole may be formed on the concave surface side or the convex surface side of the wave configuration of a corrugated sheet. In alternative, the hole may be formed on the inclined surface between the adjacent concave and convex surface sides of the wave configuration of a corrugated sheet.

The hole may extend radially or in the transverse shoe width direction. In the case of a radial center extension of a hole, the radiant point may be placed inside or outside the heel portion of a midsole, or on the edge portions of an outer circumference, and the radiant angle may be set at any angle.

Moreover, when the hole is a through hole, the cushioning properties of the whole midsole can be improved and the whole midsole can be made further lightweight.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
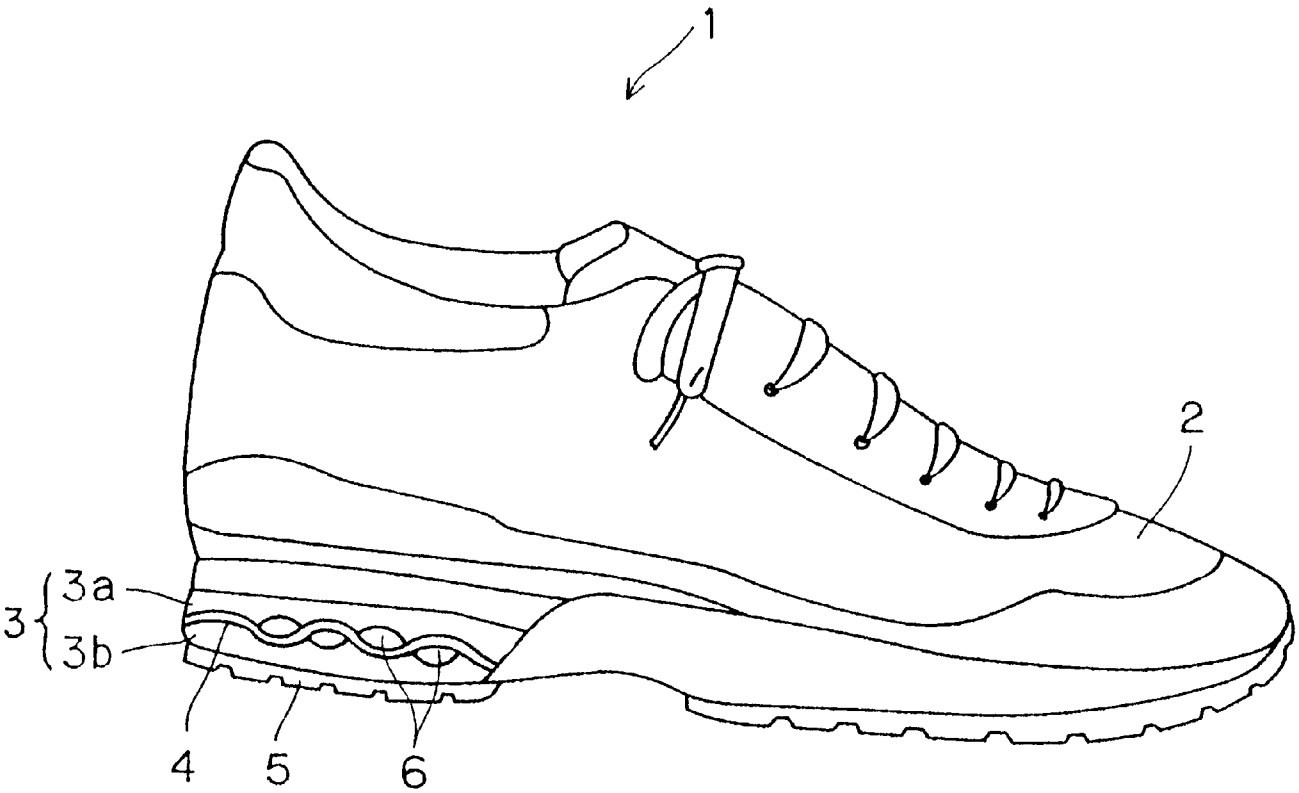
FIG. 1 is a side view of an athletic shoe incorporating the midsole construction of the present invention.

Turning now to the drawings, FIG. 1 illustrates an athletic shoe incorporating the midsole construction of the present invention. The sole of this athletic shoe 1 comprises a midsole 3, a corrugated sheet 4 and an outsole 5 directly contacting with the ground. The midsole 3 is fitted to the bottom of the uppers 2. The corrugated sheet 4 having a wavy configuration is disposed in the midsole 3. The outsole 5 is fitted to the bottom of the midsole 3.

The midsole 3 is provided in order to absorb a shock load imparted on the heel portion of the shoe 1 when landing on the ground. The midsole 3 is comprised of an upper midsole 3*a* and a lower midsole 3*b* which are respectively disposed on the top and bottom surfaces of the corrugated sheet 4. That is, the corrugated sheet 4 is interposed between the upper midsole 3*a* and the lower midsole 3*b*, and the sheet 4 is integrated with the upper and lower midsoles 3*a*, 3*b*. Namely, the upper midsole 3*a* and the lower midsole 3*b* are directly contacting and connected to the corrugated sheet 4, except at the holes 6 to be described below.

The midsole 3 is generally formed of soft elastic material having good cushioning properties. Specifically, thermoplastic synthetic resin foam such as ethylene-vinyl acetate copolymer (EVA), thermosetting resin foam such as polyurethane(PU), or rubber material foam such as butadiene or chloroprene rubber are used.

The corrugated sheet 4 is formed of thermoplastic resin such as thermoplastic polyurethane(TPU) of comparatively rich elasticity, polyamide elastomer(PAE), ABS resin and the like. Alternatively, the corrugated sheet 4 is formed of thermosetting resin such as epoxy resin, unsaturated polyester resin and the like.

Generally, in this midsole construction, the pressure imparted from the upper midsole 3*a* in landing is dispersed by the corrugated sheet 4 and the pressured area of the lower midsole 3*b* becomes enlarged. As a result, compressive hardness throughout the midsole construction is made higher.

Moreover, in this embodiment, there are provided a plurality of holes at portions where the midsole 3 contacts the corrugated sheet 4.

Figure 2:
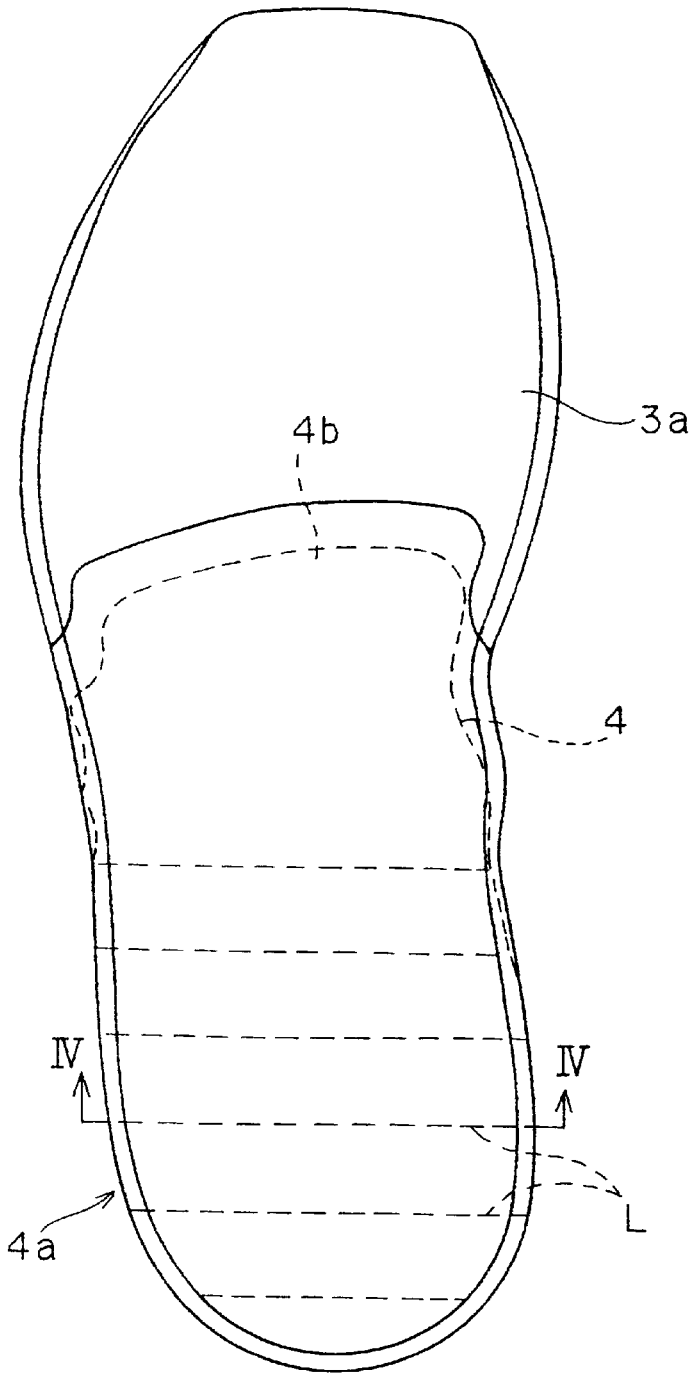
FIG. 2 is a top plan view of the left side midsole construction of the present invention.

A corrugated sheet 4, as shown in FIG. 2, extends from the heel portion to the plantar arch portion of a midsole 3. The corrugated sheet 4 is comprised of a heel portion 4*a* having a wave configuration and a plantar arch portion 4*b*, which is generally flat and integrally formed with the heel portion 4*a*. A broken line L in the drawing indicates the crest or trough line of the wave configuration of the corrugated sheet 4.

Figure 3A:
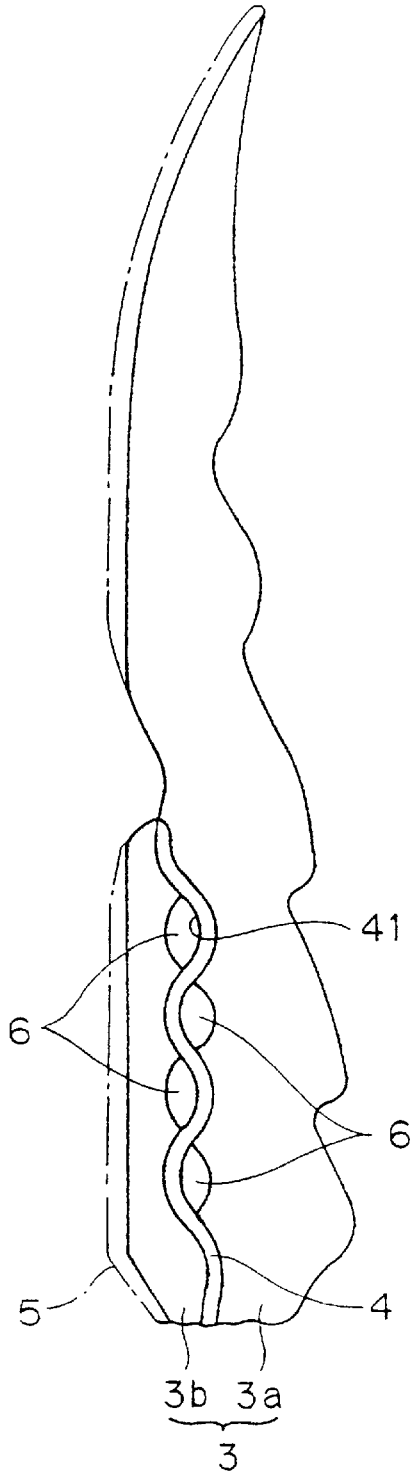
FIG. 3A is an outer side view of the midsole construction of FIG. 2.
Figure 3B:
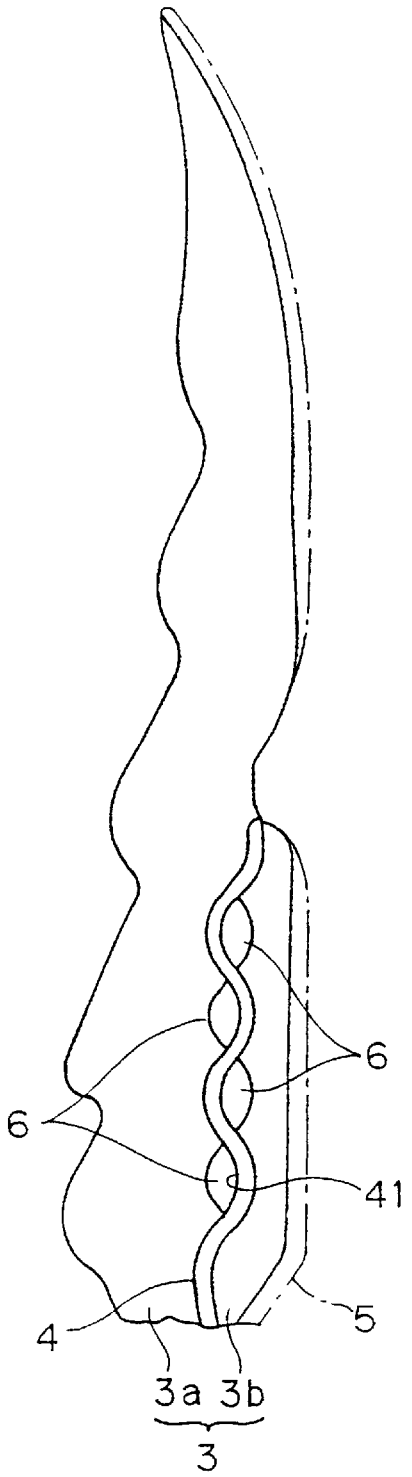
Figure 4:
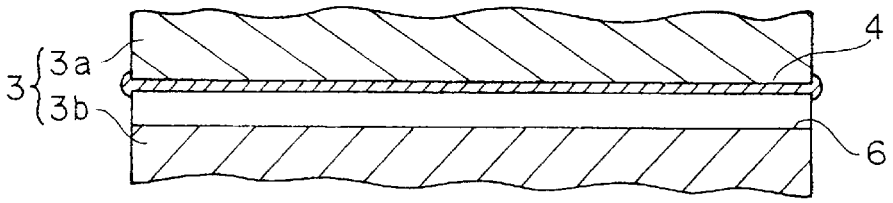
FIG. 4 is a cross sectional view taken along line IV—IV of FIG. 2.

As shown in FIGS. 3A and 3B, each of the holes 6 formed in the midsole 3 is provided on the trough side or concave surface side 41 of the wave configuration of the corrugated sheet 4. These holes 6 are through holes penetrating entirely through the midsole 3 in the width direction, as shown in FIG. 4.

In this case, since the corrugated sheet 4 is provided at least on the heel portion in the midsole 3, lateral or transverse deformation of the heel portion of the midsole 3 can be prevented and thus, stability of the shoe 1 on landing can be secured.

Furthermore, in this embodiment, a plurality of holes 6 are formed at the portions of the midsole 3 contacting the corrugated sheet 4. In these portions, provided with holes deformation of the midsole 4 in response to the vertical compressive pressure can be made easier, thus securing the cushioning properties on landing. Moreover, by forming a hole 6 in the midsole 3, the whole midsole 3 can be made lightweight and besides, the wave configuration of the corrugated sheet 4 is emphasized and appearance of the whole shoe is improved.

In addition, all the holes 6 formed in the midsole 3 are through holes and the cushioning properties of the whole midsole 3 in the lateral direction can be improved and the weight of the midsole 3 can be made further lightweight.

Figure 5:
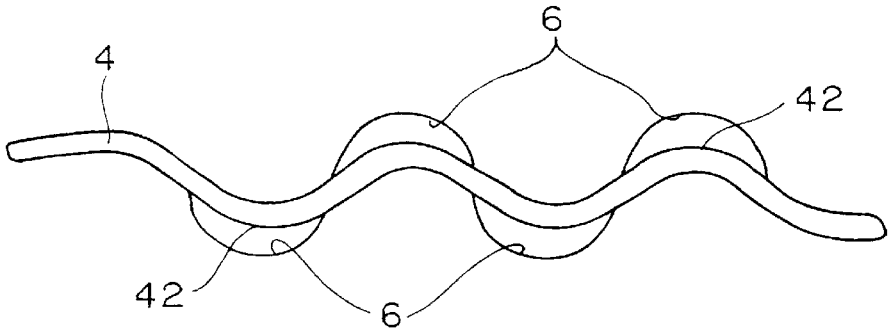
FIG. 5 is a schematic illustrating a first alternative of the midsole construction of FIG. 3.
Figure 6:
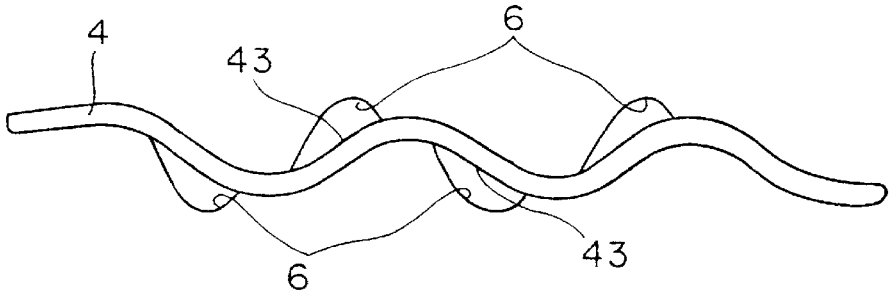
FIG. 6 is a schematic illustrating a second alternative of the midsole construction of FIG. 3.

As shown in FIG. 5, a hole 6 may be formed on the crest side or the convex surface side 42 of the wave configuration of the corrugated sheet 4, or as shown in FIG. 6, it may be formed on the inclined surface 43 between the adjacent convex and concave surfaces of the wave configuration of the corrugated sheet 4.

Figure 7:
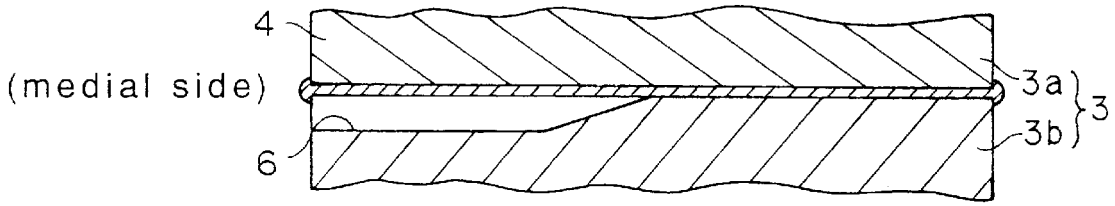
FIG. 7 is a schematic illustrating a first alternative of the midsole construction of FIG. 4.
Figure 8:
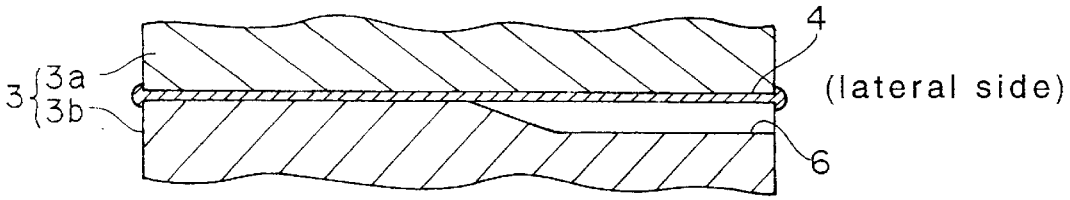
FIG. 8 is a schematic illustrating a second alternative of FIG. 4.
Figure 9:
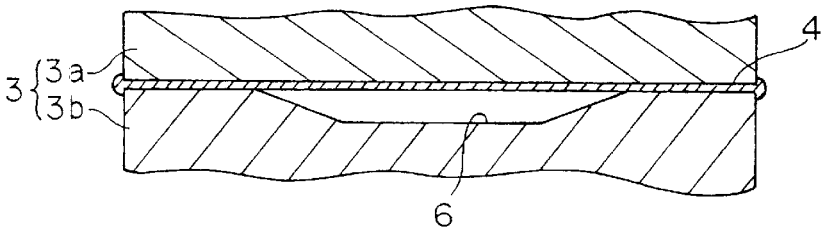
FIG. 9 is a schematic illustrating a third alternative of FIG. 4.

A hole 6 is not limited to a through hole. As shown in FIGS. 7 to 9, a hole 6 may include a bind hole with a bottom. In FIG. 7, a blind hole 6 is formed only on the inner surface side of the midsole 3 and in FIG. 8, a blind hole 6 is formed only on the outer surface side of the midsole 3. In FIG. 9, an enclosed hole 6 is provided only in the heel central portion of the midsole 3. That is, a hole 6 in FIG. 9 takes the form of an air reservoir. In these cases, a shock load on landing can be relieved on each of the portions provided with holes and the cushioning properties can be improved. Thus, control of the cushioning properties according to the sports and the athletes can be realized.

For example, in sports such as tennis or basketball where athletes land more frequently from the heel inner side portions, a hole 6 is formed only on the midsole inner surface side, whereas in sports in which athletes land more frequently from the heel outer side portions, a hole 6 is formed only on the midsole outer surface side. Moreover, in sports in which athletes land more frequently from the whole heel portions, a hole 6 is formed only on the heel central portion of the midsole.

On the other hand, at portions without a hole 6, the original function of the corrugated sheet 4 can be fully developed and the compressive hardness or hardness to deform against the compressive force is maintained, thereby preventing the heel portion of a foot from lying. As a result, over-pronation and over-supination can be prevented, and injury to the feet of athletes can be prevented.

In the embodiments shown in FIGS. 1 to 4, the holes 6 extend elongated in the shoe width direction, but the present invention is not limited to these examples. The holes 6 may extend elongated radially, as shown in FIGS. 10 and 11.

Figure 10:
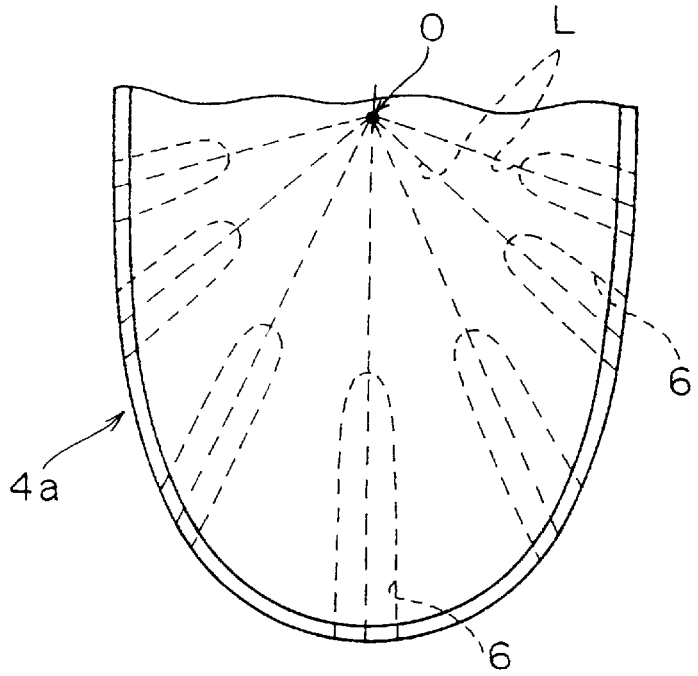
FIG. 10 is a schematic illustrating a first alternative of the midsole construction of FIG. 2.
Figure 11:
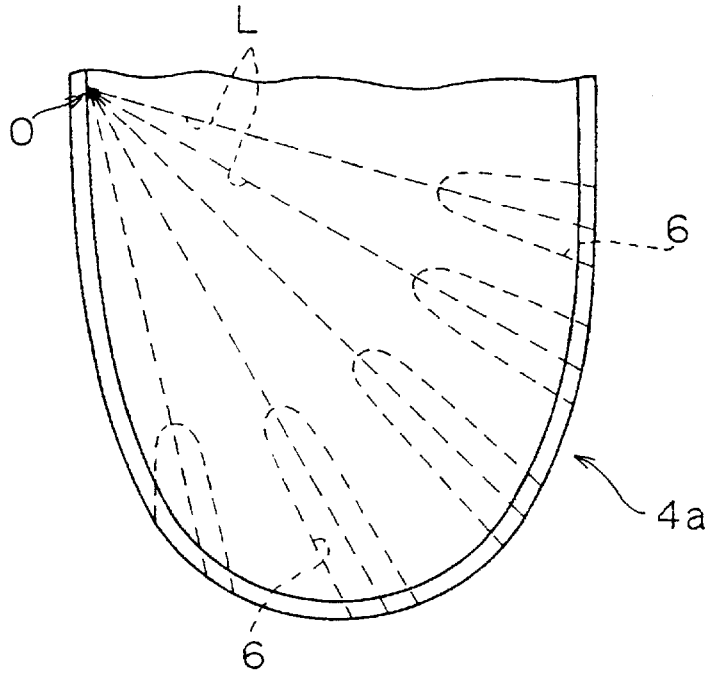
FIG. 11 is a schematic illustrating a second alternative of FIG. 2.

In FIG. 10, the radiant center point O is disposed in the heel central portion and in FIG. 11, the radiant point center O' is disposed on the outer circumference edge portions of the heel portion. In addition, the radiant angle may be obtuse, as shown in FIG. 10, or it may be an acute angle, as shown in FIG. 11. In addition to these examples, the holes may be formed in any direction at any angles including the combination of the width direction and the radiant direction.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A midsole assembly for an athletic shoe comprising:

a midsole formed of a soft elastic material and including a midsole heel portion that comprises an upper midsole portion and a lower midsole portion; and a corrugated sheet formed of a plastic resin disposed between said upper midsole portion and said lower midsole portion of said midsole heel portion;

wherein said corrugated sheet has a corrugated wave configuration including a plurality of linearly extending wave crests and wave troughs;

wherein said midsole heel portion has at least one hole therein directly adjoining said corrugated sheet;

wherein said at least one hole respectively is a linearly extending groove in one of said upper midsole portion and said lower midsole portion, said groove extends linearly along one of said linearly extending wave crests and wave troughs of said corrugated sheet, and said groove faces and opens directly onto said corrugated sheet;

wherein said upper midsole portion and said lower midsole portion are directly contacting and connected to said corrugated sheet except at said at least one hole, where said upper midsole portion or said lower midsole portion respectively having said hole does not contact and is not connected to said corrugated sheet.

2. The midsole assembly according to claim 1, wherein each one of said wave crests has a convex crest surface on a first surface of said corrugated sheet and a concave crest surface on a second surface of said corrugated sheet opposite said first surface;

wherein each one of said troughs has a concave trough surface on said first surface of said corrugated sheet and a convex trough surface on said second surface of said corrugated sheet; and wherein said at least one hole is respectively disposed at and linearly extending along a respective one of said concave crest surface and said concave trough surface.

3. The midsole assembly according to claim 1, wherein each one of said wave crests has a convex crest surface on a first surface of said corrugated sheet and a concave crest surface on a second surface of said corrugated sheet opposite said first surface;

wherein each one of said troughs has a concave trough surface on said first surface of said corrugated sheet and a convex trough surface on said second surface of said corrugated sheet; and wherein said at least one hole is respectively disposed at and linearly extending along a respective one of said convex crest surface and said convex trough surface.

4. The midsole assembly according to claim 1, wherein each one of said wave crests has a convex crest surface on a first surface of said corrugated sheet and a concave crest surface on a second surface of said corrugated sheet opposite said first surface;

wherein each one of said troughs has a concave trough surface on said first surface of said corrugated sheet and a convex trough surface on said second surface of said corrugated sheet;

wherein said corrugated sheet further includes respective inclined surfaces extending respectively between said convex crest surfaces and said concave trough surfaces, and between said concave crest surfaces and said convex trough surfaces; and wherein said at least one hole is disposed at and linearly extending along a respective one of said inclined surfaces.

5. The midsole assembly according to claim 1, wherein said midsole assembly extends in a longitudinal direction adapted to correspond to a length direction of a shoe in which said midsole assembly may be incorporated; and wherein said at least one hole respectively linearly extends in a width direction of said midsole assembly that extends crosswise relative to said longitudinal direction.

6. The midsole assembly according to claim 5, wherein said at least one hole includes a plurality of holes that all respectively linearly extend parallel to each other in said width direction.

7. The midsole assembly according to claim 1, wherein said at least one hole includes a plurality of holes that respectively linearly extend radially along respective radial lines radiating from a common radiant center point.

8. The midsole assembly according to claim 1, wherein said midsole heel portion is bounded by a medial side edge and a lateral side edge; and wherein said at least one hole is respectively a through hole that extends linearly entirely through said midsole heel portion from said medial side edge to said lateral side edge and that has two respective open hole ends opening respectively in said medial side edge and said lateral side edge.

9. The midsole assembly according to claim 1, wherein said midsole heel portion is bounded by a medial side edge and a lateral side edge, wherein said at least one hole is respectively a blind hole that extends linearly only partially through said midsole heel portion between said medial side edge and said lateral side edge; and wherein said blind hole has one open hole end opening in one of said medial and lateral side edges, and one closed blind end within said midsole heel portion.

10. The midsole assembly according to claim 9, wherein said open hole end is located in said medial side edge.

11. The midsole assembly according to claim 9, wherein said open hole end is located in said lateral side edge.

12. The midsole assembly according to claim 1, wherein said at least one hole is respectively an enclosed chamber that is limited to a central portion of said midsole heel portion.

13. The midsole assembly according to claim 1, wherein said midsole further includes a plantar arch portion, and said midsole assembly further comprises a flat non-corrugated sheet that extends integrally from said corrugated sheet into and along said plantar arch portion of said midsole.

* * * * *

UNITED STATES PATENT AND TRADEMARK OFFICE

CERTIFICATE OF CORRECTION

PATENT NO. : 6,205,681 B1
DATED : March 27, 2001
INVENTOR(S) : Kita

It is certified that error appears in the above-identified patent and that said Letters Patent is hereby corrected as shown below:

Column 1,
Line 49, after "the", replace "sale of" by -- sole --;

Column 2,
Line 19, after "midsole (2nd occurrence), replace "said" by -- side --;

Column 3,
Line 3, after "view", insert -- and Fig. 3B is an inner side view --;

Column 4,
Line 17, after "holes", insert -- , --;
Line 35, after "a" (2nd occurrence), replace "bind" by -- blind --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*